US008376593B2

(12) United States Patent
Bazydola et al.

(10) Patent No.: US 8,376,593 B2
(45) Date of Patent: Feb. 19, 2013

(54) THERMAL TRIM FOR A LUMINAIRE

(75) Inventors: Sarah Bazydola, Belmont, MA (US); Camil-Daniel Ghiu, Danvers, MA (US); Robert Harrison, North Andover, MA (US); Anil Jeswani, Beverly, MA (US)

(73) Assignee: Osram Sylvania Inc., Danvers, MA (US)

( * ) Notice: Subject to any disclaimer, the term of this patent is extended or adjusted under 35 U.S.C. 154(b) by 321 days.

(21) Appl. No.: 12/770,884

(22) Filed: Apr. 30, 2010

(65) Prior Publication Data

US 2011/0267828 A1 Nov. 3, 2011

(51) Int. Cl.
*F21V 29/00* (2006.01)

(52) U.S. Cl. ..... 362/373; 362/147; 362/294

(58) Field of Classification Search ..... 362/147, 362/249.02, 294, 311.02, 364, 373
See application file for complete search history.

(56) References Cited

U.S. PATENT DOCUMENTS

| | | | | |
|---|---|---|---|---|
| 7,261,437 | B2 | 8/2007 | Coushaine et al. | |
| 7,585,089 | B2 | 9/2009 | Swantner et al. | |
| 7,598,534 | B2 | 10/2009 | Swantner et al. | |
| 2008/0165535 | A1* | 7/2008 | Mazzochette | 362/294 |
| 2009/0086474 | A1* | 4/2009 | Chou | 362/230 |
| 2009/0097262 | A1* | 4/2009 | Zhang et al. | 362/364 |
| 2009/0321749 | A1 | 12/2009 | Peiler | |
| 2011/0063831 | A1* | 3/2011 | Cook | 362/235 |

FOREIGN PATENT DOCUMENTS

| | | | |
|---|---|---|---|
| WO | 2008/036873 | A2 | 3/2008 |
| WO | 2008/061084 | A1 | 5/2008 |

OTHER PUBLICATIONS

Alfonso De Mas, International Search Report and Written Opinion of the International Searching Authority, Nov. 3, 2011, pp. 1-10, European Patent Office, Rijswijk, The Netherlands.

* cited by examiner

*Primary Examiner* — David V Bruce
(74) *Attorney, Agent, or Firm* — Shaun P. Montana

(57) ABSTRACT

A luminaire with a thermal pathway to reduce the junction temperature of the luminaire's light source, and methods for so doing, are disclosed. The luminaire includes a can, a light engine, and a trim, that define a substantially continuous thermal pathway from the light engine to a surrounding environment. The can defines a can cavity and includes a can end region. The light engine is within the can cavity and includes a light source and a heat sink, including a heat sink end region, coupled thereto. The trim is at least partially disposed within the can cavity and includes a first trim end region coupled to the heat sink end region and a second trim end region coupled to the can end region. Thermal interface material may be located between: the heat sink and the trim, the trim and the can, and/or the heat sink and the light source.

18 Claims, 5 Drawing Sheets

THERMAL TRIM FOR A LUMINAIRE

GOVERNMENT RIGHTS

This invention was made with U.S. Government support under DOE Cooperative Agreement No. DE-FC26-08NT01582, awarded by the U.S. Department of Energy. The U.S. Government may have certain rights in this invention.

TECHNICAL FIELD

The present disclosure relates to luminaires, and more particularly pertains to luminaires and methods for reducing the junction temperature of one or more solid state light sources in a light engine.

BACKGROUND

Luminaires, such as downlights or the like, provide light from a light source. One such type of light source includes a solid state light source, such as light emitting diodes (LEDs). While LEDs may generate less heat compared to traditional bulbs (e.g., incandescent light bulbs), LEDs nevertheless generate heat. The generated heat should be managed in order to control the junction temperature of the LEDs. A higher junction temperature generally correlates to a lower light output and thus lower luminaire efficiency. Conventional solid state light sources typically include heat sinks coupled to the LEDs to dissipate the heat generated during operation of the LEDs. However, the ability of the heat sink to dissipate heat may be limited in a variety of ways due to the luminaire, such as its shape, location, and the like. As a result, the junction temperature of the LEDs may limit the light output of the luminaire. Operating LEDs at lower junction temperature generally increases the reliability and light output of the luminaire.

SUMMARY

Embodiments disclosed herein overcome limitations found in conventional luminaires by decreasing the junction temperature of the solid state light source(s) and thus increasing the thermal efficiency and light output of the luminaire. Embodiments achieve this by providing a substantially continuous thermal pathway between a luminaire's light engine, which includes the light source, and the fixture in which the light engine is installed. As used throughout, the term "junction temperature" refers to the maximum temperature of the solid state light source(s) in a light engine (for example, but not limited to, when operating at steady state power). By providing a substantially continuous thermal pathway between the light engine and the fixture (e.g., a can), the junction temperature of the solid state light sources in the light engine may be reduced. Additionally, or alternatively, the thickness of a trim of the fixture may also be varied to reduce the junction temperature. Because the junction temperature of the solid state light sources in the light engine may be reduced, the light engine may be operated at higher power, thereby increasing the power output of the light engine, and thus the luminaire, while also maintaining an acceptable service life.

In an embodiment, there is provided a luminaire. The luminaire includes a can defining a can cavity, wherein the can includes a can end region; a light engine disposed within the can cavity, the light engine comprising at least one light source and a heat sink coupled to the at least one light source, wherein the heat sink includes a heat sink end region; and a trim at least partially disposed within the can cavity, the trim comprising a first trim end region coupled to the heat sink end region and a second trim end region coupled to the can end region, wherein the light engine, the trim and the can define a substantially continuous thermal pathway between the light engine and the can.

In a related embodiment, the at least one light source may include at least one light emitting diode coupled to a printed circuit board, and wherein the printed circuit board and the heat sink may abut against a first thermal interface material. In a further related embodiment, the first thermal interface material may include a deformable material having a thermal conductivity. In a further related embodiment, the thermal conductivity of the deformable material may be at least 1.0 W/(m*K).

In another related embodiment, the first trim end region may abut against the heat sink end region.

In yet another related embodiment, the first trim end region and the heat sink end region may abut against a second thermal interface material. In a further related embodiment, the second thermal interface material may include a deformable material having a thermal conductivity. In a further related embodiment, the thermal conductivity of the deformable material may be at least 1.0 W/(m*K).

In another further related embodiment, the first trim end region and the heat sink end region may each include a flange configured to be coupled together, and wherein each of the flanges may abut against the second thermal interface material. In a further related embodiment, at least one of the flanges may define a lens cavity configured to receive at least a portion of a periphery of a lens.

In another related embodiment, the second trim end region may abut against the can end region.

In still yet another related embodiment, the second trim end region and the can end region may abut against a third thermal interface material. In a further related embodiment, the third thermal interface material may include a deformable material having a thermal conductivity. In a further related embodiment, the thermal conductivity of the deformable material may be at least 1.0 W/(m*K).

In another further related embodiment, the second trim end region and the can end region may each include a flange configured to be coupled together, and wherein each of the flanges abuts against the third thermal interface material.

In another embodiment, there is provided a luminaire. The luminaire includes a can defining a can cavity, wherein the can includes a can end region; a light engine disposed within the can cavity, the light engine comprising at least one light emitting diode coupled to a printed circuit board, and a heat sink coupled to the printed circuit board, wherein the heat sink includes a heat sink end region; a first thermal interface material abutting the printed circuit board and the heat sink; a trim at least partially disposed within the can cavity, the trim comprising a first trim end region and a second trim end region, wherein the first trim end region is coupled to the heat sink end region and the second trim end region is coupled to the can end region; a second thermal interface material abutting the first trim end region and the heat sink end region; and a third thermal interface material abutting the second trim end region and the can end region; wherein the first, the second, and the third thermal interface material comprise a deformable material having a thermal conductivity and wherein the light engine, the trim and the can define a substantially continuous thermal pathway between the light engine and the can.

In a related embodiment, the first trim end region and the heat sink end region may each include a flange configured to be coupled together, and wherein each of the flanges abuts against the second thermal interface material. In a further related embodiment, at least one of the flanges may define a lens cavity configured to receive at least a portion of a periphery of a lens.

In another embodiment, there is provided a method of reducing a junction temperature of a solid state light source of a luminaire. The method includes providing a substantially continuous thermal pathway between the solid state light source and a can of the luminaire, wherein the can defines a can cavity and wherein the solid state light source is disposed within the can cavity, by: contacting a printed circuit board and a heat sink, wherein the solid state light source is coupled to the printed board, wherein the heat sink includes a heat sink end region; contacting a first trim end region of a trim of the luminaire to the heat sink end region, wherein the trim of the luminaire is at least partially disposed within the can cavity; and contacting a second trim end region of the trim of the luminaire to a can end region of the can; generating heat at the light source; and transferring heat from the light source to the can via the substantially continuous thermal pathway.

In a related embodiment, providing further may include contacting a first thermal interface material against the printed circuit board and the heat sink, the first thermal interface material comprising a deformable material having a thermal conductivity; contacting a second thermal interface material against the first trim end region and the heat sink end region, the first thermal interface material comprising a deformable material having a thermal conductivity; and contacting a third thermal interface material against the second trim end region and the can end region, the first thermal interface material comprising a deformable material having a thermal conductivity.

BRIEF DESCRIPTION OF THE DRAWINGS

The foregoing and other objects, features and advantages disclosed herein will be apparent from the following description of particular embodiments disclosed herein, as illustrated in the accompanying drawings in which like reference characters refer to the same parts throughout the different views. The drawings are not necessarily to scale, emphasis instead being placed upon illustrating the principles disclosed herein.

DETAILED DESCRIPTION

Figure 1:
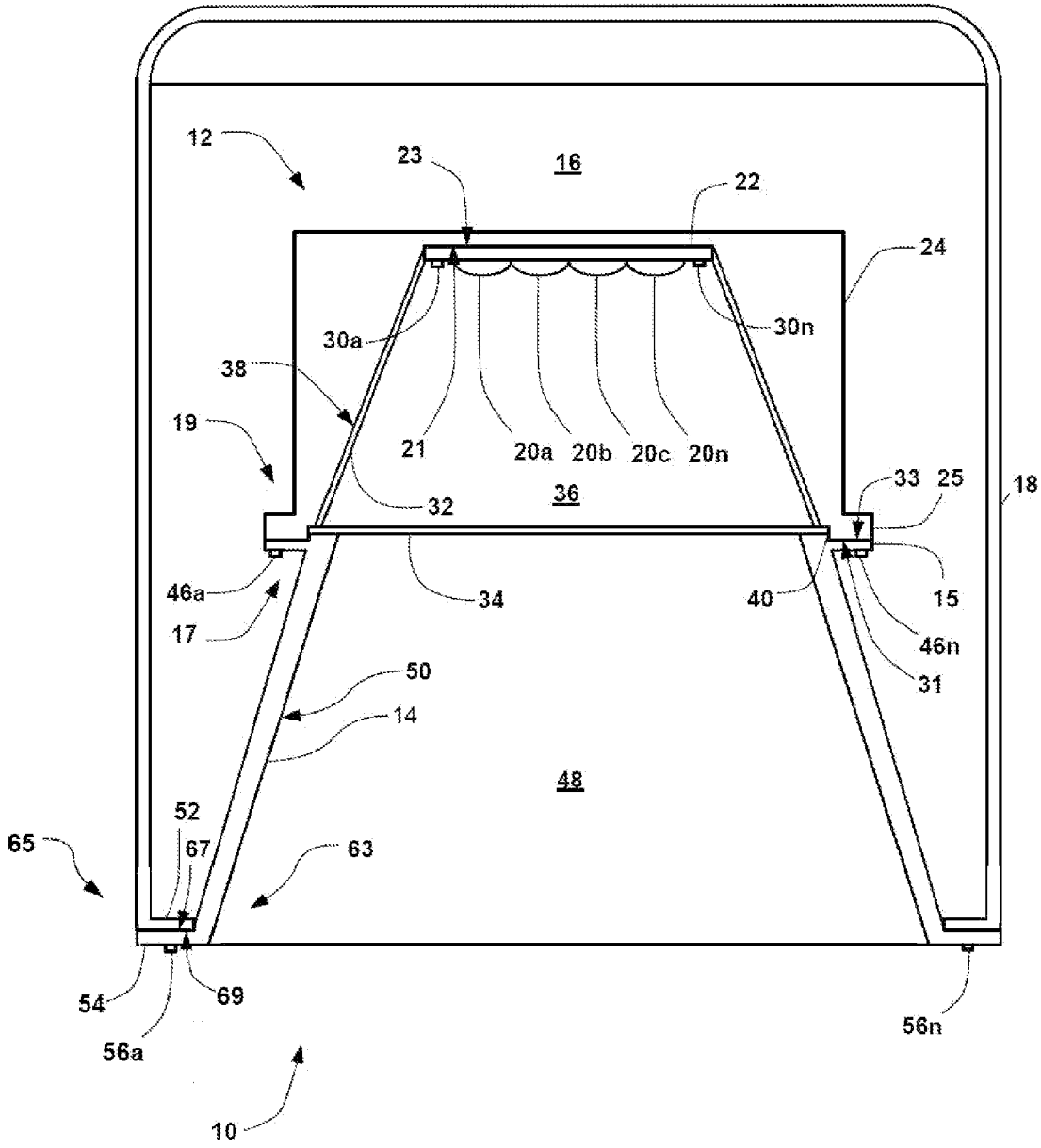
FIG. 1 is a cross-sectional view of a luminaire according to embodiments described herein.

Referring to FIG. 1, a cross-sectional view of a luminaire 10 is generally illustrated. The luminaire 10 includes a light engine 12 and a trim 14, each of which may be at least partially disposed within a can cavity 16 defined by a can 18. The light engine 12 may comprise any light source including, but not limited to, gas discharge light sources (such as, but not limited to, high intensity discharge lamps, fluorescent lamps, low pressure sodium lamps, metal halide lamps, high pressure sodium lamps, high pressure mercury-vapor lamps, neon lamps, and/or xenon flash lamps) as well as one or more solid-state light sources (e.g., but not limited to, semiconductor light-emitting diodes (LEDs), organic light-emitting diodes (OLED), or polymer light-emitting diodes (PLED)). The light source will be referred to herein as "LEDs 20*a-n*". The number, color, and/or arrangement of LEDs 20*a-n* may depend upon the intended application/performance of the luminaire 10. The LEDs 20*a-n* may be coupled and/or mounted to a substrate 22 (for example, but not limited to, a ballast, PCB or the like). The substrate 22 as shown in FIG. 1 is typically a PCB, and is thus referred to herein as a PCB 22. The PCB 22 may comprise additional circuitry (not shown for clarity purposes) including, but not limited to, resistors, capacitors, etc., as is well known in the art, and which may be operatively coupled to the PCB 22 and configured to drive or control (e.g., power) the LEDs 20*a-n*.

The light engine 12 may also comprise one or more heat sinks 24 coupled to the PCB 22. The heat sink 24 may have an enlarged surface area to absorb and dissipate heat generated by the LEDs 20*a-n*. The heat sink 24 may be made from a material with very good thermal conductivity such as, but not limited to, a material having a thermal conductivity of 100 W/(m*K) or greater, for example, 200 W/(m*K) or greater. In some embodiments, the heat sink 24 may include a metal (such as, but not limited to, aluminum, copper, silver, gold, or the like), metal alloys, plastics (e.g., but not limited to, doped plastics), as well as composites. The size, shape and/or configuration (e.g., surface area) of the heat sink 24 may depend upon a number of variables including, but not limited to, the maximum power rating of the light engine 12, the size/shape of the can 18 (e.g., the size/shape of the can cavity 16), and the like. In some embodiments, the PCB 22 may be directly coupled to the heat sink 24. For example, a first surface 21 of the PCB 22 may contact or abut against a surface 23 of the heat sink 24 to conduct heat away from the LEDs 20*a-n*.

In some embodiments, the light engine 12 may also include one or more thermal interface materials (e.g., gap pads). For example, a first thermal interface material 26 (shown in FIG. 2) may be disposed between the PCB 22 and the heat sink 24 to decrease the contact thermal resistance between the PCB 22 (and LEDs 20*a-n*) and the heat sink 24. The first thermal interface material 26 may include outer surfaces 27, 28 which directly contact (e.g., abut against) surfaces 21, 23 of the PCB 22 and the heat sink 24, respectively. The first thermal interface material 26 may be a material having a reasonably high thermal conductivity, k, configured to reduce the thermal resistance between the PCB 22 and the heat sink 24. For example, the first thermal interface material 26 may have a thermal conductivity, k, of 1.0 W/(m*K) or greater, 1.3 W/(m*K) or greater, 2.5 W/(m*K) or greater, 5.0 W/(m*K) or greater, 1.3-5.0 W/(m*K), 2.5-5.0 W/(m*K), or any value or range therein. The first thermal interface material 26 may be a deformable (e.g., a resiliently deformable) material configured to reduce and/or eliminate air pockets between the outer surfaces 27, 28 of the PCB 22 and the heat sink 24 to reduce contact resistance. The first thermal interface material 26 may also have a high conformability to reduce interface resistance.

The first interface material 26 may have a thickness of 0.010 inches to 0.250 inches when uncompressed. In some embodiments, one or more outer surfaces 27, 28 of the first thermal interface material 26 may include an adhesive layer (not shown for clarity) configured to secure the first thermal interface material 26 to the PCB 22 or the heat sink 24, respectively. The adhesive layer may be selected to facilitate heat transfer (e.g., the adhesive layer may have a thermal conductivity k of 1 W/(m*K) or greater). Additionally, or alternatively, the PCB 22 and the heat sink 24 may be coupled (e.g., secured) together using one or more fasteners 30*a-n* such as, but not limited to, screws, rivets, bolts, clamps, or the like. The first thermal interface material 26 may also be electrically non-conductive (i.e., an electrical insulator) and may include a dielectric material.

Referring back to FIG. 1, the light engine 12 may optionally include a reflector 32 and/or a lens 34. The reflector 32 may be configured to direct and/or focus light emitted from the LEDs 20*a-n* out of the luminaire 10. The reflector 32 may define a light engine cavity 36 through which the light may pass through. In some embodiments, the reflector 32 may be substantially coextensive with an inner surface 38 of the heat sink 24. The reflector 32 may also have a reasonably high thermal conductivity, k, (e.g., but not limited to, a thermal conductivity, k, of 1.0 W/(m*K) or greater) to transfer heat from the light engine cavity 36 into the heat sink 24, thereby reducing the junction temperature of the LEDs 20*a*-20*n* that are part of the light engine 12. Similarly, the lens 34 may also be configured to direct and/or focus light emitted from the LEDs 20*a-n* out of the luminaire 10. In some embodiments, the lens 34 may be configured to diffuse the light emitted from the LEDs 20*a-n*. The lens 34 may be secured between and/or to the heat sink 24, the reflector 32, and/or the trim 14.

In some embodiments, the trim 14 and the heat sink 24 may be coupled together. For example, a first trim end region 17 and a heat sink end region 24 may, respectively, include flanges 15, 25. When the first trim end region 17 and the heat sink end region 24 are coupled together, the flanges 15, 25 may define a lens cavity 40 configured to receive at least a portion of the outer periphery of the lens 34, such that the lens 34 is sandwiched between the heat sink 24 and the trim 14. Of course, the lens 34 may be secured between and/or to the heat sink 24, reflector 32, and/or trim 14 in a variety of different manners. For example, while not an exhaustive list, the lens 34 may be an integral component with the reflector 32 or the trim 14 and/or may be secured to the heat sink 24 and/or trim 14 using a fastener, adhesive, welding (e.g., but not limited to, ultrasonic welding), or the like (not shown for clarity).

The trim 14 and the heat sink 24 may include surfaces 31, 33 (e.g., surfaces of the flanges 15, 25, respectively) which may be directly coupled to each other (e.g., abutting or contact). In some embodiments, the luminaire 10 may include one or more second thermal interface materials 42 (e.g., gap pads) (shown in FIG. 2) disposed between the heat sink 24 and the trim 14. The second thermal interface material 42 further increases the rate of heat transferred from the heat sink 24 to the trim 14 (and ultimately away from the LEDs 20*a-n* and the PCB 22). For example, the second thermal interface material 42 may include outer surfaces 44, 45 which directly contact (e.g., abut against) surfaces 31, 33 of the trim 14 and the heat sink 24, respectively. In some embodiments, the second thermal interface material 42 may be disposed between one or more of the flange(s) 15, 25 of the trim 14 and the heat sink 24.

The second thermal interface material 42 may include a material having a reasonably high thermal conductivity, k, configured to reduce the thermal resistance between the trim 14 and the heat sink 24. For example, the second thermal interface material 42 may have a thermal conductivity k of 1.0 W/(m*K) or greater, 1.3 W/(m*K) or greater, 2.5 W/(m*K) or greater, 5.0 W/(m*K) or greater, 1.3-5.0 W/(m*K), 2.5-5.0 W/(m*K), or any value or range therein. The second thermal interface material 42 may include a deformable (e.g., a resiliently deformable) material configured to reduce and/or eliminate air pockets between the outer surfaces 31, 33 of the trim 14 and the heat sink 24 to reduce contact resistance. The second thermal interface material 42 may have a high conformability to reduce interfacial resistance.

The second thermal interface material 42 may have a thickness of 0.010 inches to 0.250 inches when uncompressed. In some embodiments, one or more outer surfaces 44, 45 of the second thermal interface material 42 may include an adhesive layer (not shown for clarity) configured to secure the second thermal interface material 42 to the heat sink 24 or the trim 14, respectively. Additionally, or alternatively, the heat sink 24 and the trim 14 may be secured together using one or more fasteners 46*a-n* such as, but not limited to, screws, rivets, bolts, clamps, or the like. The second interface material 42 may also be electrically non-conductive (i.e., an electrical insulator), and may include a dielectric material.

Referring back to FIG. 1, the trim 14 may define a trim cavity 48 configured to receive the light emitted from the light engine cavity 36. The inner surface 50 of the trim 14 may include a reflective (e.g., mirror-like) coating. The trim 14 may include a material having a high thermal conductivity, k, (e.g., but not limited to, a thermal conductivity, k, of 20.0 W/(m*K) or greater) to transfer heat away from the heat sink 24, thereby reducing the junction temperature of the LEDs 20*a*-20*n* that are part of the light engine 12. In some embodiments, the trim 14 may include a metal (such as, but not limited to, aluminum, copper, silver, gold, or the like), metal alloys, plastics (e.g., but not limited to, plastics doped to increase the thermal conductivity k), as well as composites.

In some embodiments, the trim 14 and the can 18 may be coupled together. For example, a second trim end region 63 and a can end region 65 may be secured together across one or more flanges 52, 54, respectively. The trim 14 and the can 18 may include surfaces 67, 69 (e.g., surface of the flanges 52, 54, respectively) which may be directly coupled to each other (e.g., abutting or contact). In some embodiments, the luminaire 10 may include one or more third thermal interface materials 58 (e.g., gap pads) (shown in FIG. 2) disposed between the trim 14 and the can 18 to further increase the rate of heat transferred from the trim 14 to the can 18 (and ultimately away from the LEDs 20*a-n* and the PCB 22). For example, the third thermal interface material 58 may include outer surfaces 71, 73 which directly contact (e.g., abut against) surfaces 67, 69 of the trim 14 and the can 18, respectively. In some embodiments, the third thermal interface material 58 may be disposed between one or more of the flange(s) 52, 54 of the trim 14 and the can 18.

The third thermal interface material 58 may include a material having a high thermal conductivity, k, configured to reduce the contact resistance between the trim 14 and the can 18. For example, the third interface material 58 may have a thermal conductivity, k, of 1.0 W/(m*K) or greater, 1.3 W/(m*K) or greater, 2.5 W/(m*K) or greater, 5.0 W/(m*K) or greater, 1.3-5.0 W/(m*K), 2.5-5.0 W/(m*K), or any value or range therein. The third thermal interface material 58 may include a deformable (e.g., a resiliently deformable) material configured to reduce and/or eliminate air pockets between the outer surfaces 67, 69 of the trim 14 and the can 18 to reduce contact resistance. The third interface material 58 may have a high conformability to reduce interfacial resistance.

The third thermal interface material 58 may have a thickness of 0.010 inches to 0.250 inches when uncompressed. In some embodiments, one or more outer surfaces 71, 73 of the third thermal interface material 58 may include an adhesive layer (not shown for clarity) configured to secure the third thermal interface material 58 to the trim 14 or the can 18, respectively. Additionally, or alternatively, the trim 14 and the can 18 may be secured to each other using one or more fasteners 56*a-n* extending at least partially through a portion of the flanges 52, 54. The trim 14 and the can 18 may also be coupled to each other using an adhesive, welding (e.g., but not limited to, ultrasonic welding or the like), clamps, etc. The third thermal interface material 58 may also be electrically non-conductive (i.e., an electrical insulator), and may include a dielectric material.

The can 18 may be coupled to a support surface (e.g., but not limited to, a wall surface, ceiling surface, wall stud, ceiling rafter, drop ceiling, etc., not shown for clarity), by, for example, using one or more brackets or the like (also not shown for clarity). The can 18 may include a material having a reasonably high thermal conductivity, k, (e.g., but not limited to, a thermal conductivity k of 20.0 W/(m*K) or greater) to transfer heat away from the thermal trim 14, thereby reducing the junction temperature of the LEDs 20*a*-20*n* that are part of the light engine 12. In some embodiments, the can 18 may include a metal (such as, but not limited to, aluminum, copper, silver, gold, or the like), metal alloys, plastics (e.g., but not limited to, plastics doped to increase the thermal conductivity k), as well as composites.

Figure 3:
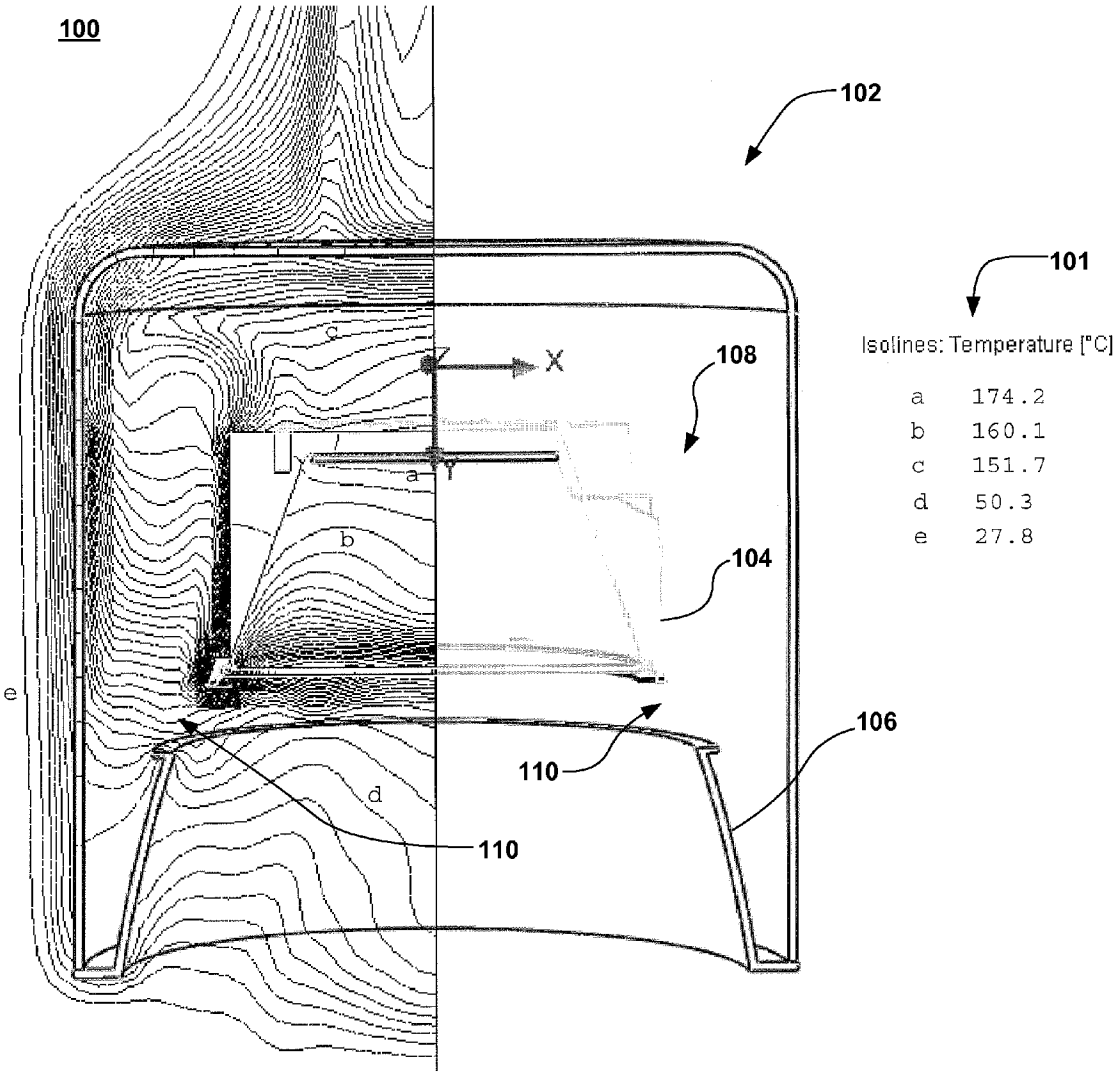
FIG. 3 depicts a thermal image of a conventional 26 Watt luminaire.

Turning now to FIG. 3, a thermal image 100 of a conventional luminaire 102 is generally shown (note, the thermal image 100 features a temperature profile ranging between 25° C. and 174.2° C. as indicated in the temperature key 101). The heat sink 104 of the traditional luminaire 102 is not coupled to the trim 106. As such, heat generated by the light engine 108 is conducted directly to a region of air 110. As may be appreciated, air has a very low thermal conductivity, for example, in the order of approximately 0.02457 W/(m*K). As such, very little heat may be conducted from the heat sink 104 to the trim 106 through the region of air 110. The traditional luminaire 102 was simulated to have a PCB junction temperature of 174.2° C.

Figure 2:
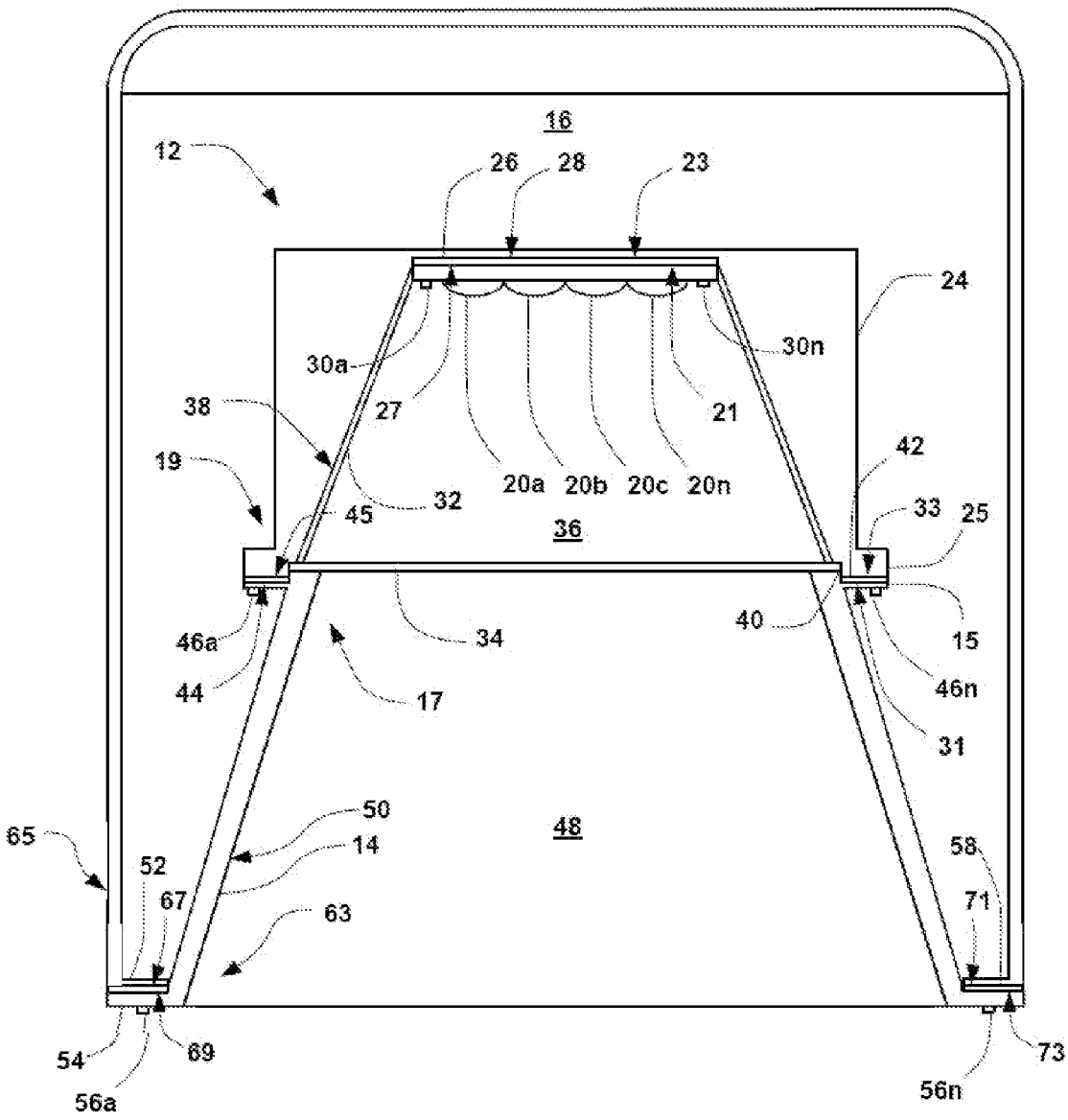
FIG. 2 is a cross-sectional view of another embodiment of a luminaire according to embodiments described herein.
Figure 4:
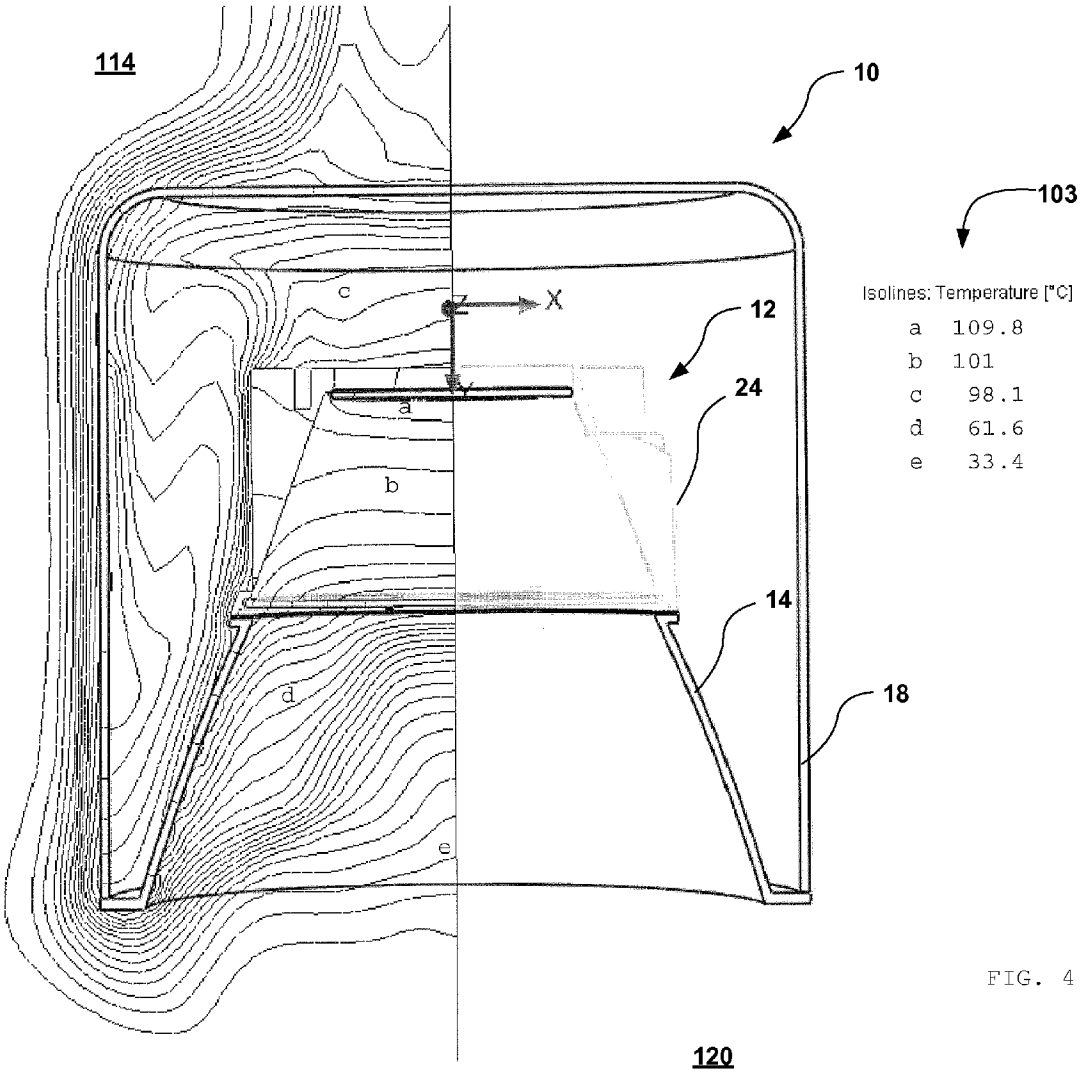
FIG. 4 depicts a thermal image of a 26 Watt luminaire according to embodiments described herein.

In contrast, a thermal image 120 of a 26 Watt luminaire 10 consistent with FIG. 2 is illustrated in FIG. 4 (note, the thermal image 120 features a temperature profile ranging between 25° C. and 109.8° C. as indicated in the temperature key 103). The arrangement of the heat sink 24, the trim 14 and the can 18 provides substantially continuous thermal pathway between the light engine 12 and the environment 114. The luminaire 10 as illustrated in FIG. 4 was simulated to have a PCB junction temperature of 64.4° C. As may therefore be appreciated, the luminaire 10 of FIG. 4 has a PCB junction temperature that is 64.4° C. less than the traditional luminaire 102 at the same wattage.

As used herein, a substantially continuous thermal pathway between the light engine 12 and the environment 114 is intended to mean that heat generated by the light engine 12 may be transferred to from the LEDs 20*a*-*n*/PCB 22, to the heat sink 24, to the trim 14, and to the can 18 through direct physical contact between the adjacent components (e.g., abutting each other) and/or through thermal interface materials abutting the adjacent components (i.e., without the need to be transferred through air). The use of the thermal interface materials 26, 42, and/or 58 may further increase the rate of heat transfer away from the light engine 12 by eliminating/reducing any air pockets between the PCB 22, heat sink 24, trim 14, and can 18. The term "air pockets" is intended to refer to small voids between two surfaces which are in at least partial contact with each other, and is not intended to refer to larger gaps between adjacent components.

Thus, a luminaire 10 according to embodiments described throughout may include a light engine 12 (e.g., a heat sink 24) coupled to the trim 14, and optionally the trim 14 coupled to the can 18. For example, first end regions 17, 19 of the trim 14 and the heat sink 24 may be directly coupled together as generally illustrated in FIG. 1. Optionally, a thermal interface material 42 may be disposed between the end regions 17, 19 such that the thermal interface material 42 contacts surfaces 31, 33 of the trim 14 and the heat sink 24 as generally illustrated in FIG. 2. Additionally, the second end region 63 of the trim 14 may be directly coupled to the first end region 65 of the can 18 as generally illustrated in FIG. 1. Optionally, a thermal interface material 58 may be disposed between the end regions 63, 65 such that the thermal interface material 58 contacts surfaces 67, 69 of the trim 14 and the can 18 as generally illustrated in FIG. 2. The arrangement of the heat sink 24, trim 14 and can 18 as generally illustrated in FIGS. 1 and 2 provides substantially continuous thermal pathway between the light engine 12 (e.g., the LEDs 20*a*-*n* and PCB 22) and the environment 114. Accordingly, heat generated by the operation of the light engine 12 may be dissipated more efficiently from the light engine 12 (and in particular, the LEDs 20*a*-*n* and/or the PCB 22), thereby lowering the junction temperature of the LEDs 20*a*-20*n* in the luminaire 10.

Figure 5:
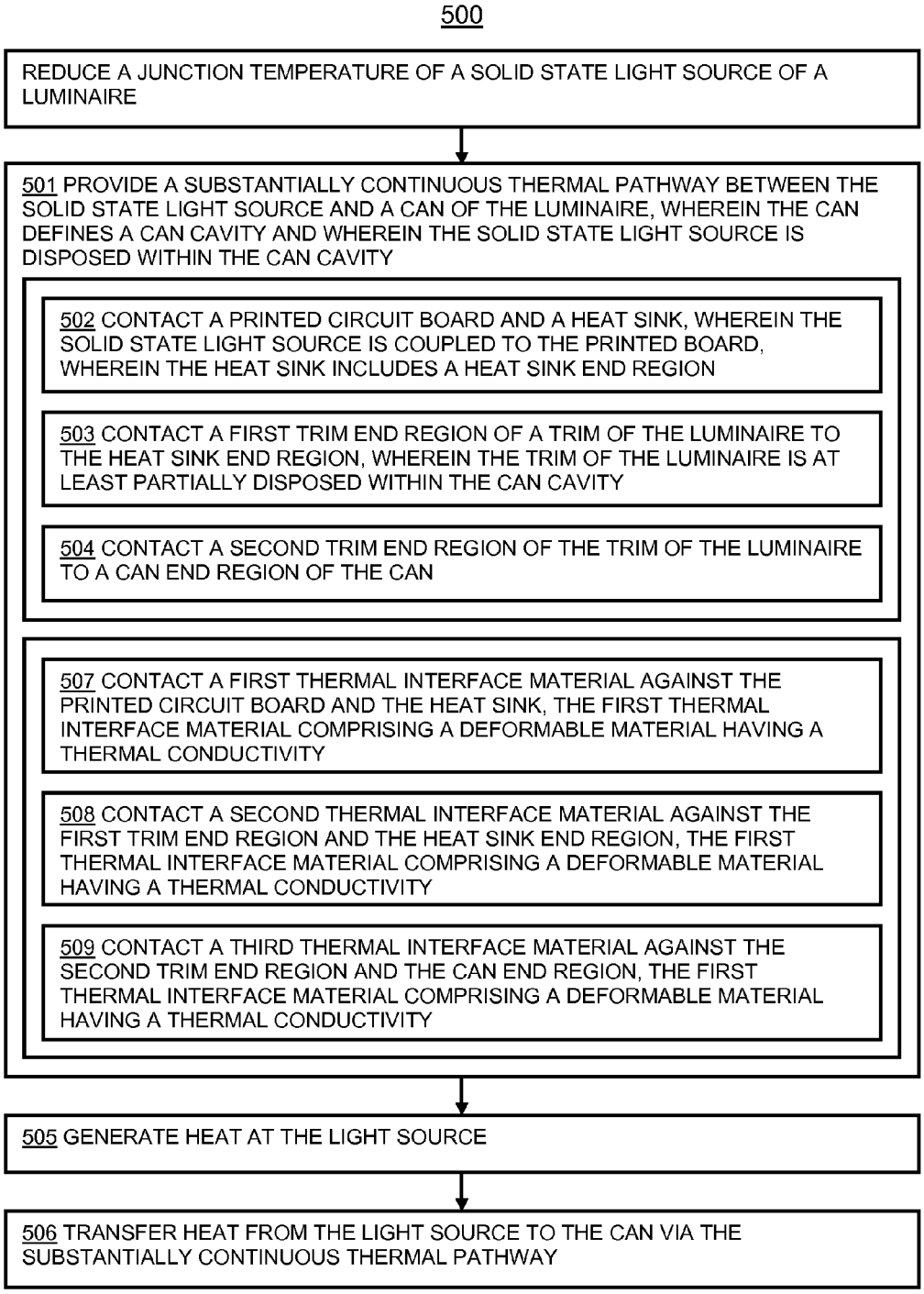
FIG. 5 is a flowchart of methods to reduce the junction temperature of light sources within a luminaire according to embodiments described herein.

A flowchart 500 of the presently disclosed method is illustrated in FIG. 5. It will be appreciated by those of ordinary skill in the art that unless otherwise indicated herein, the particular sequence of steps described is illustrative only and may be varied without departing from the spirit of the invention. Thus, unless otherwise stated, the steps described below are unordered, meaning that, when possible, the steps may be performed in any convenient or desirable order. More specifically, FIG. 5 illustrates a flowchart 500 of a method to reduce the junction temperature of a solid state light source of a luminaire. A substantially continuous thermal pathway is provided between the solid state light source and a can of the luminaire, step 501. The can of the luminaire defines a can cavity and the solid state light source is disposed within the can cavity. The substantially continuous thermal pathway is provided through various steps. A printed circuit board and a heat sink are contacted, step 502, wherein the solid state light source is coupled to the printed board and wherein the heat sink includes a heat sink end region. A first trim end region of a trim of the luminaire is contacted to the heat sink end region, step 503, wherein the trim of the luminaire is at least partially disposed within the can cavity. A second trim end region of the trim of the luminaire is contacted to a can end region of the can, step 504. Heat is generated at the light source, step 505, and heat is transferred from the light source to the can via the substantially continuous thermal pathway, step 506.

In some embodiments, providing a substantially continuous thermal pathway is provided between the solid state light source and a can of the luminaire, step 501, may include: contacting a first thermal interface material against the printed circuit board and the heat sink, step 507, the first thermal interface material comprising a deformable material having a thermal conductivity; contacting a second thermal interface material against the first trim end region and the heat sink end region, step 508, the first thermal interface material comprising a deformable material having a thermal conductivity; and contacting a third thermal interface material against the second trim end region and the can end region, step 509, the first thermal interface material comprising a deformable material having a thermal conductivity.

Unless otherwise stated, use of the word "substantially" may be construed to include a precise relationship, condition, arrangement, orientation, and/or other characteristic, and deviations thereof as understood by one of ordinary skill in the art, to the extent that such deviations do not materially affect the disclosed methods and systems.

Throughout the entirety of the present disclosure, use of the articles "a" or "an" to modify a noun may be understood to be used for convenience and to include one, or more than one, of the modified noun, unless otherwise specifically stated.

Elements, components, modules, and/or parts thereof that are described and/or otherwise portrayed through the figures to communicate with, be associated with, and/or be based on, something else, may be understood to so communicate, be associated with, and or be based on in a direct and/or indirect manner, unless otherwise stipulated herein.

Although the methods and systems have been described relative to a specific embodiment thereof, they are not so limited. Obviously many modifications and variations may become apparent in light of the above teachings. Many additional changes in the details, materials, and arrangement of parts, herein described and illustrated, may be made by those skilled in the art.

What is claimed is:

1. A luminaire comprising:

a can defining a can cavity, wherein the can includes a can end region;

a light engine disposed within the can cavity, the light engine comprising at least one light source and a heat sink coupled to the at least one light source, wherein the heat sink includes a heat sink end region, wherein the at least one light source comprises at least one light emitting diode coupled to a printed circuit board, and wherein the printed circuit board and the heat sink abut against a first thermal interface material, wherein the first thermal interface material comprises a deformable material having a thermal conductivity; and a trim at least partially disposed within the can cavity, the trim comprising a first trim end region coupled to the heat sink end region and a second trim end region coupled to the can end region;

wherein the light engine, the trim and the can define a substantially continuous thermal pathway between the light engine and the can.

2. The luminaire of claim 1 wherein the thermal conductivity of the deformable material is at least 1.0 W/(m*K).

3. The luminaire of claim 1 wherein the first trim end region abuts against the heat sink end region.

4. The luminaire of claim 1 wherein the first trim end region and the heat sink end region abut against a second thermal interface material.

5. The luminaire of claim 4 wherein the second thermal interface material comprises a deformable material having a thermal conductivity.

6. The luminaire of claim 5 wherein the thermal conductivity of the deformable material is at least 1.0 W/(m*K).

7. The luminaire of claim 4 wherein the first trim end region and the heat sink end region each comprise a flange configured to be coupled together, and wherein each of the flanges abuts against the second thermal interface material.

8. The luminaire of claim 7, wherein at least one of the flanges defines a lens cavity configured to receive at least a portion of a periphery of a lens.

9. The luminaire of claim 1, wherein the second trim end region abuts against the can end region.

10. The luminaire of claim 1, wherein the second trim end region and the can end region abut against a third thermal interface material.

11. The luminaire of claim 10, wherein the third thermal interface material comprises a deformable material having a thermal conductivity.

12. The luminaire of claim 11 wherein the thermal conductivity of the deformable material is at least 1.0 W/(m*K).

13. The luminaire of claim 10, wherein the second trim end region and the can end region each comprise a flange configured to be coupled together, and wherein each of the flanges abuts against the third thermal interface material.

14. A luminaire comprising:

a can defining a can cavity, wherein the can includes a can end region;

a light engine disposed within the can cavity, the light engine comprising at least one light emitting diode coupled to a printed circuit board, and a heat sink coupled to the printed circuit board, wherein the heat sink includes a heat sink end region;

a first thermal interface material abutting the printed circuit board and the heat sink;

a trim at least partially disposed within the can cavity, the trim comprising a first trim end region and a second trim end region, wherein the first trim end region is coupled to the heat sink end region and the second trim end region is coupled to the can end region;

a second thermal interface material abutting the first trim end region and the heat sink end region; and a third thermal interface material abutting the second trim end region and the can end region;

wherein the first, the second, and the third thermal interface material comprise a deformable material having a thermal conductivity and wherein the light engine, the trim and the can define a substantially continuous thermal pathway between the light engine and the can.

15. The luminaire of claim 14, wherein the first trim end region and the heat sink end region each comprise a flange configured to be coupled together, and wherein each of the flanges abuts against the second thermal interface material.

16. The luminaire of claim 15, wherein at least one of the flanges defines a lens cavity configured to receive at least a portion of a periphery of a lens.

17. A method of reducing a junction temperature of a solid state light source of a luminaire, the method comprising:

providing a substantially continuous thermal pathway between the solid state light source and a can of the luminaire, wherein the can defines a can cavity and wherein the solid state light source is disposed within the can cavity, by:

contacting a printed circuit board and a heat sink, wherein the solid state light source is coupled to the printed board, wherein the heat sink includes a heat sink end region, wherein the printed circuit board and the heat sink abut against a first thermal interface material, and wherein the first thermal interface material comprises a deformable material having a thermal conductivity;

contacting a first trim end region of a trim of the luminaire to the heat sink end region, wherein the trim of the luminaire is at least partially disposed within the can cavity; and contacting a second trim end region of the trim of the luminaire to a can end region of the can;

generating heat at the light source; and transferring heat from the light source to the can via the substantially continuous thermal pathway.

18. The method of claim 17, wherein providing further comprises:

contacting a first thermal interface material against the printed circuit board and the heat sink, the first thermal interface material comprising a deformable material having a thermal conductivity;

contacting a second thermal interface material against the first trim end region and the heat sink end region, the second thermal interface material comprising a deformable material having a thermal conductivity; and contacting a third thermal interface material against the second trim end region and the can end region, the third thermal interface material comprising a deformable material having a thermal conductivity.

* * * * *